United States Patent [19]

Grange

[11] 3,939,015

[45] Feb. 17, 1976

[54] IN-LINE HEAT TREATMENT OF HOT-ROLLED ROD

[75] Inventor: Raymond A. Grange, Washington Township, Westmoreland County, Pa.

[73] Assignee: United States Steel Corporation, Pittsburgh, Pa.

[22] Filed: Dec. 18, 1974

[21] Appl. No.: 534,001

[52] U.S. Cl. ..... 148/12 B; 148/156
[51] Int. Cl.[2] ..... C21D 7/14; C21D 9/52
[58] Field of Search ..... 148/12 B, 12.4, 156

[56] References Cited

UNITED STATES PATENTS

| | | | |
|---|---|---|---|
| 3,320,101 | 5/1967 | McLean et al. | 148/36 |
| 3,390,871 | 7/1968 | McLean et al. | 148/156 |
| 3,584,494 | 6/1971 | Geipel et al. | 148/12 B |
| 3,711,338 | 1/1973 | Vitelli | 148/12 B |

*Primary Examiner*—W. Stallard
*Attorney, Agent, or Firm*—Arthur J. Greif

[57] ABSTRACT

Hot rolled steel rod, containing less than 0.4% C, is cooled by a prescribed, interrupted-cooling procedure for producing rod with enhanced ability to receive cold work. In cooling from the austenite range, the rod is held within a specified, narrow temperature range for a period of at least about 2 minutes. The particular holding range is shown to be a function of carbon content, whereby low carbon steels (<0.28% C) are held at a prescribed temperature above 1,450°F, while medium carbon steels are held at a temperature of about 1,250°F.

24 Claims, 11 Drawing Figures a

<2 MIN.

b

3 MIN.

c

5 MIN.

d

7 MIN.

e

10 MIN.

IN-LINE HEAT TREATMENT OF HOT-ROLLED ROD

This invention relates to a method for heat treating hot rolled rod, and is more specifically related to a method for directly cooling hot rolled rod in order to produce a metallurigical structure capable of receiving a maximum amount of subsequent cold work.

Steel wire is produced in a wide variety of sizes, shapes and mechanical properties for countless end-uses. Whatever the application, virtually all such wire is produced in essentially the same manner, i.e., by drawing rod through a tapered hole or a series of such holes. Prior to such drawing, however, depending primarily on the carbon content, the rod is heat-treated to produce substantially different metallurigical structures. Thus, when the carbon content of the rod (or wire) is in excess of about 0.4%, it is usually desirable to have a structure with an optimum combination of high tensile strength and ductility. Such a structure may be imparted by a reheating procedure known as "patenting" or by directly cooling from above the $A_3$ temperature, utilizing procedures such as shown by German Pat. No. 888,399 or U.S. Pat. No. 3,231,432. The resulting structures impart to the rod or wire the ability to withstand heavy drafting so as to produce a finished wire product with an optimum of strength and toughness. On the other hand, when the end-use products are made from low and medium carbon rod, i.e. rod with less than 0.4% C, quite different considerations are generally involved. For example, cold heading properties will be of prime concern when low carbon rod is employed for the production of nails. Similarly, in the production of bolts or screws, machinability will be of prime concern. Therefore, in the production of low carbon rod, it is often desirable that the rod be in a rather soft condition and exhibit a metallurigical structure approximating what may be an "annealed" structure. In terms of mechanical properties, it is desirable to have a metallurigical structure which may easily be cold-worked (i.e. as evidenced by low yield strength) in combination with one having a high capacity to receive and store such deformation (i.e. low ratio of yield strength to tensile strength). In the low carbon steels of concern here, these properties are controlled to a substantial extent by the properties of the ferrite matrix and more particularly by the ferrite grain size. One method for maximizing ferrite grain size would be a rather long (e.g. > 12 hours) isothermal heat-treatment at a temperature near the $A_1$. Such a procedure would produce a maximum amount of ferrite, in combination with ample time for grain growth. Although this procedure could easily be effected in the laboraory, the use of such long time periods would be clearly impractical in commercial production; and especially so, for the continuous, in-line processing of hot-rolled rod. Consider, for example, a commercial processing line analogous to that shown in U.S. Pat. No. 3,645,805, wherein hot-rolled rod is initially cooled to some temperature above the $A_3$, and is then deposited in nonconcentric, offset rings onto a moving conveyor (heat treatment zone) where the rod may be cooled in a variety of ways to provide a final product with a reasonably uniform structure along the entire length of the rod. Such conveyors are fed by rod issuing from very high speed rod mills. In view thereof, in order to prevent snags and pile-ups, these moving conveyors must generally travel at minimum speeds of the order of 10 ft./min. It may be seen that even with a conveyor length of 100 ft., that the maximum permissible treatment time will therefore only be 10 minutes. It is, of course, possible to increase somewhat the length of the conveyor and/or to employ a slightly slower line speed. However, for practical purposes, the heat-treatment times in commercial practice will generally be "constrained" to a time period of no more than about 15 minutes, and more often to a time period of no more than 10 minutes.

It is therefore a principal object of this invention to provide a heat treatment for producing rod with a combination of (i) low yield strength and (ii) low ratio of yield strength to tensile strength, in a "constrained period" of time.

It is yet another object of this invention to provide a rod exhibiting such a combination of properties, uniformly along extended lengths of rod, i.e. rod lengths produced from billets weighing at least about 500 lbs., and generally in excess of 1,000 lbs.

It is also an object of this invention to provide a method for heat treating rod in a constrained period of time, to produce a metallurgical structure approaching that of an "annealed" structure.

These and other objects and advantages of the invention will be more apparent from a reading of the following description when taken in conjunction with the appended claims and the drawings, in which;

Figure 1:
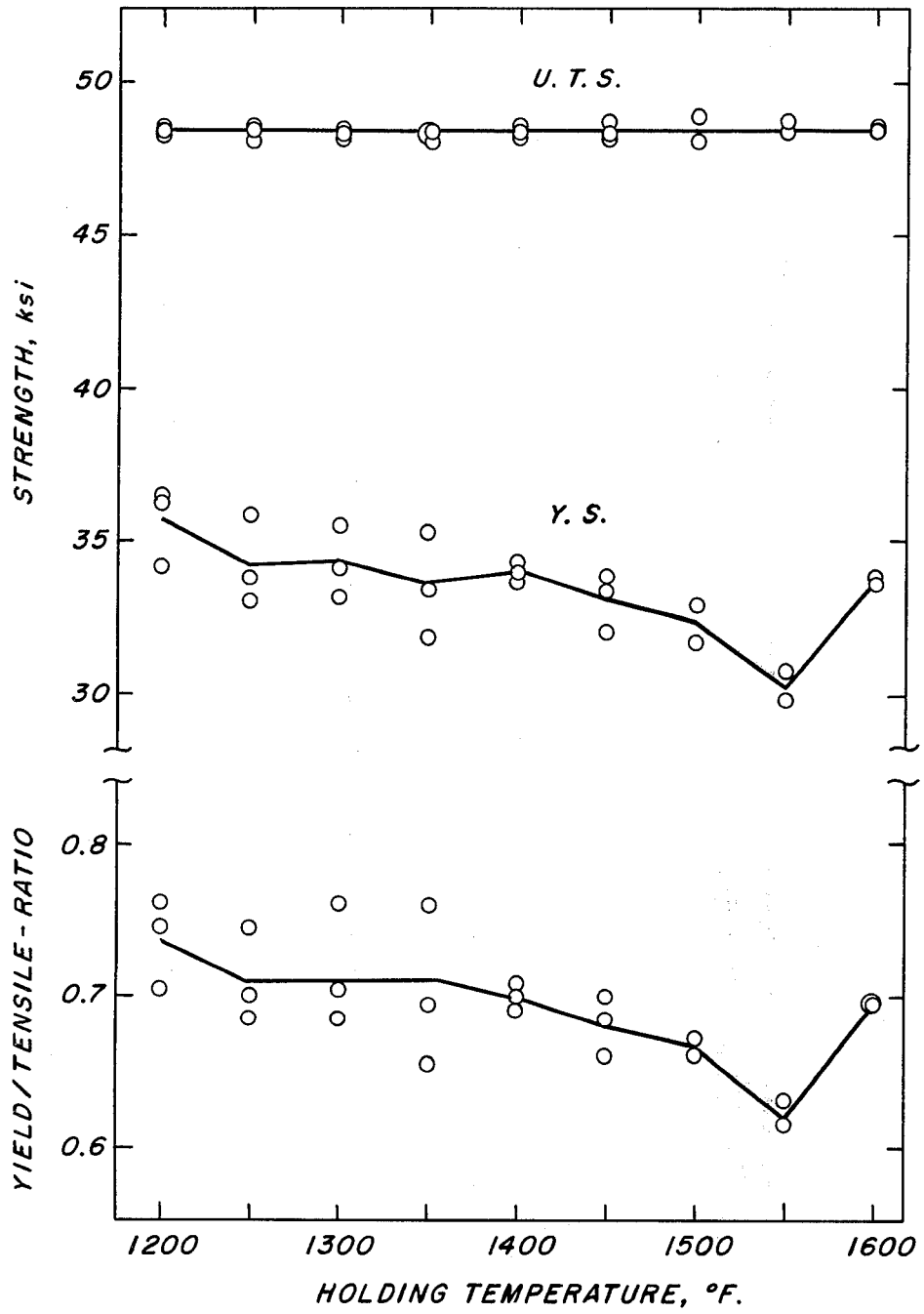
FIGS. 1 through 5 are graphical representations, illustrating the effect of interrupted cooling at various temperatures on the mechanical properties of five representative steel rods.
Figure 2:
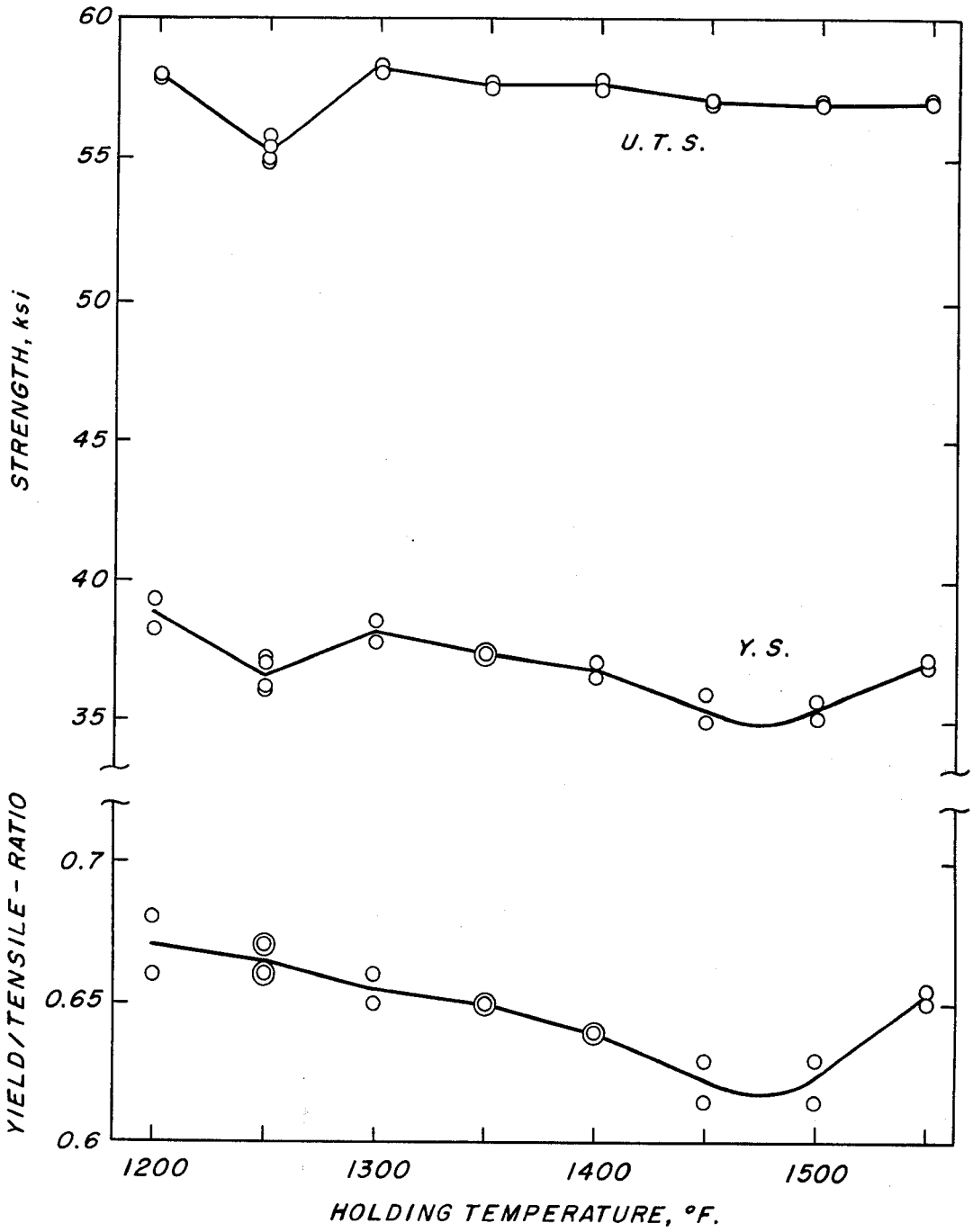
Figure 3:
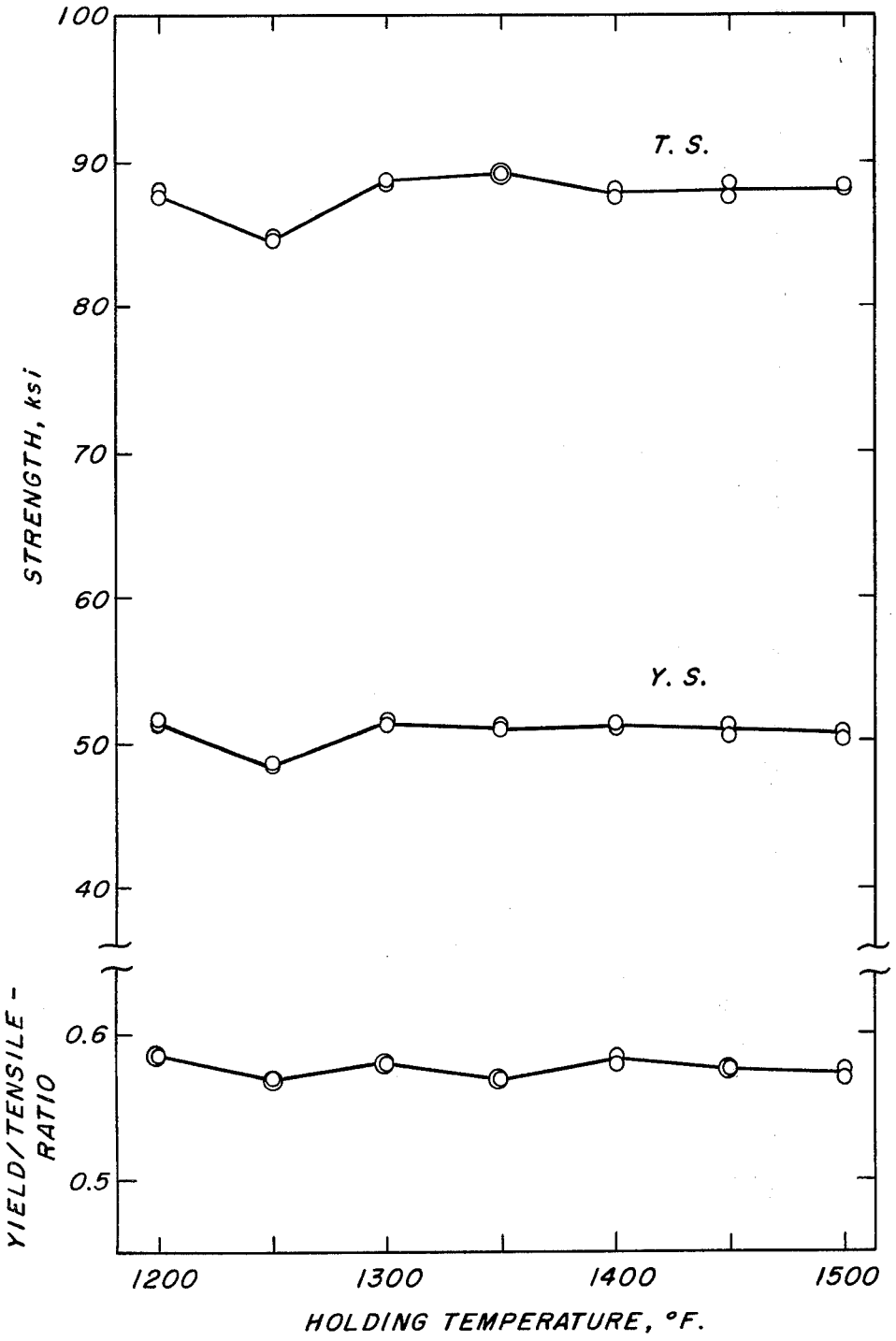
Figure 4:
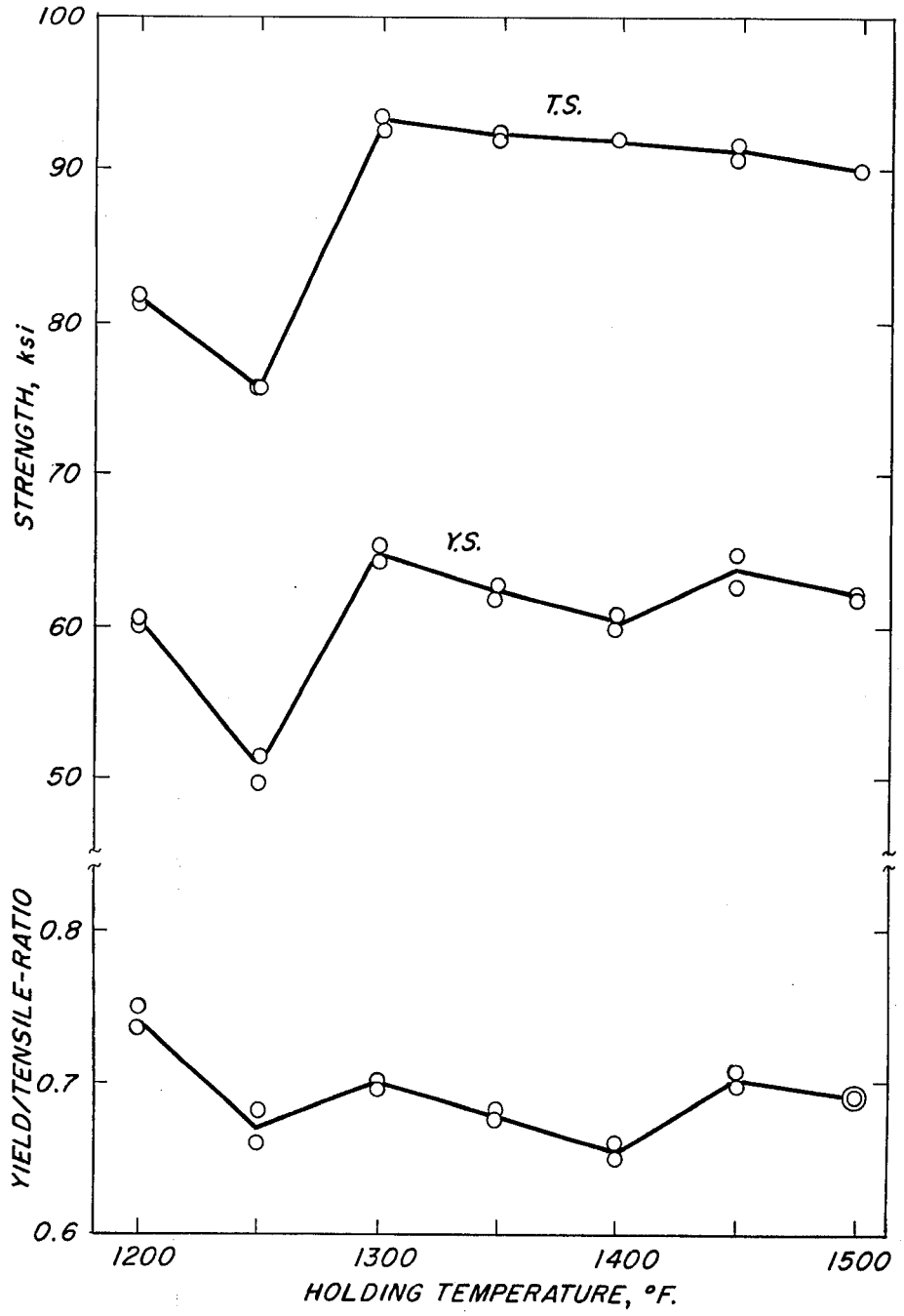
Figure 5:
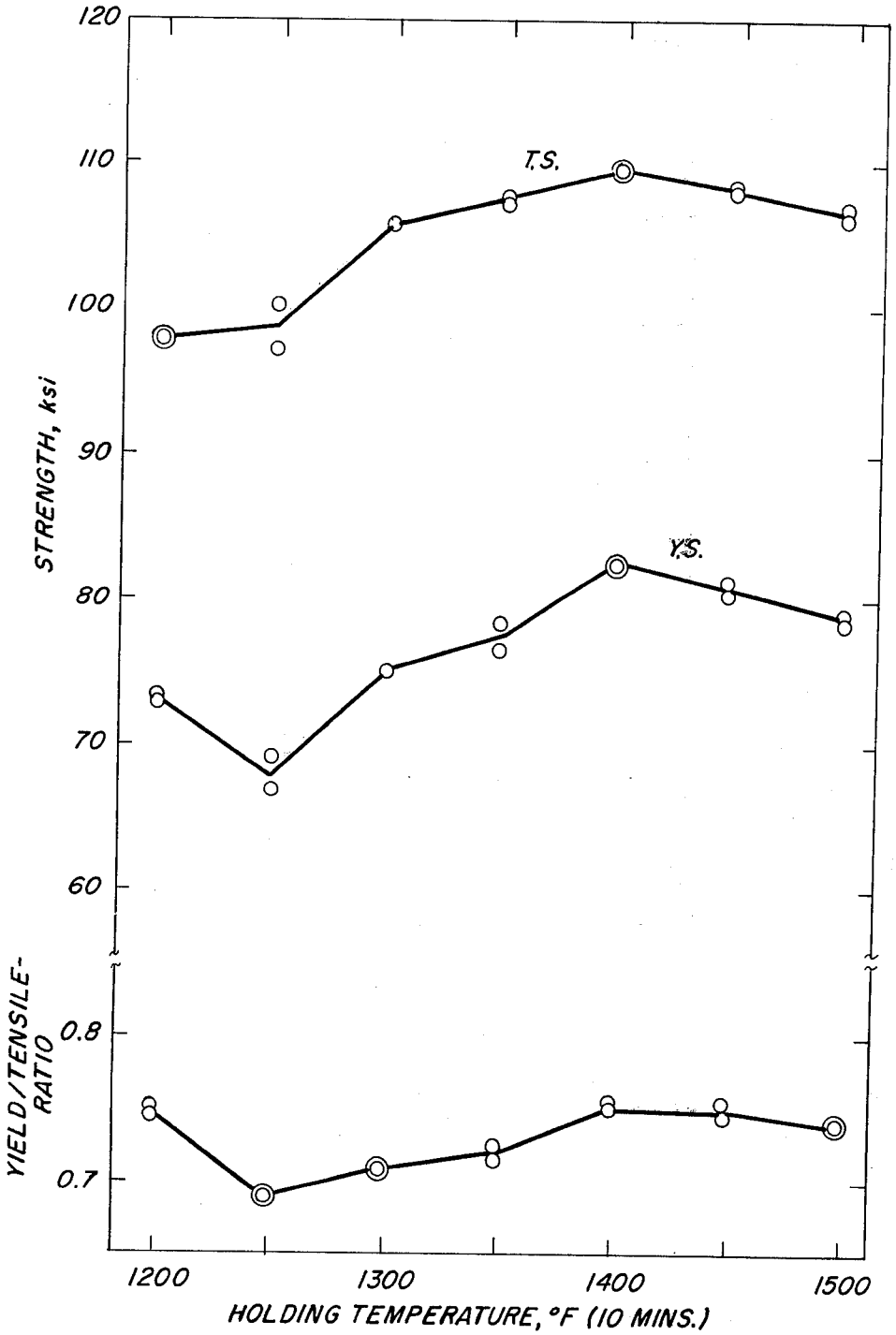
Figure 6:
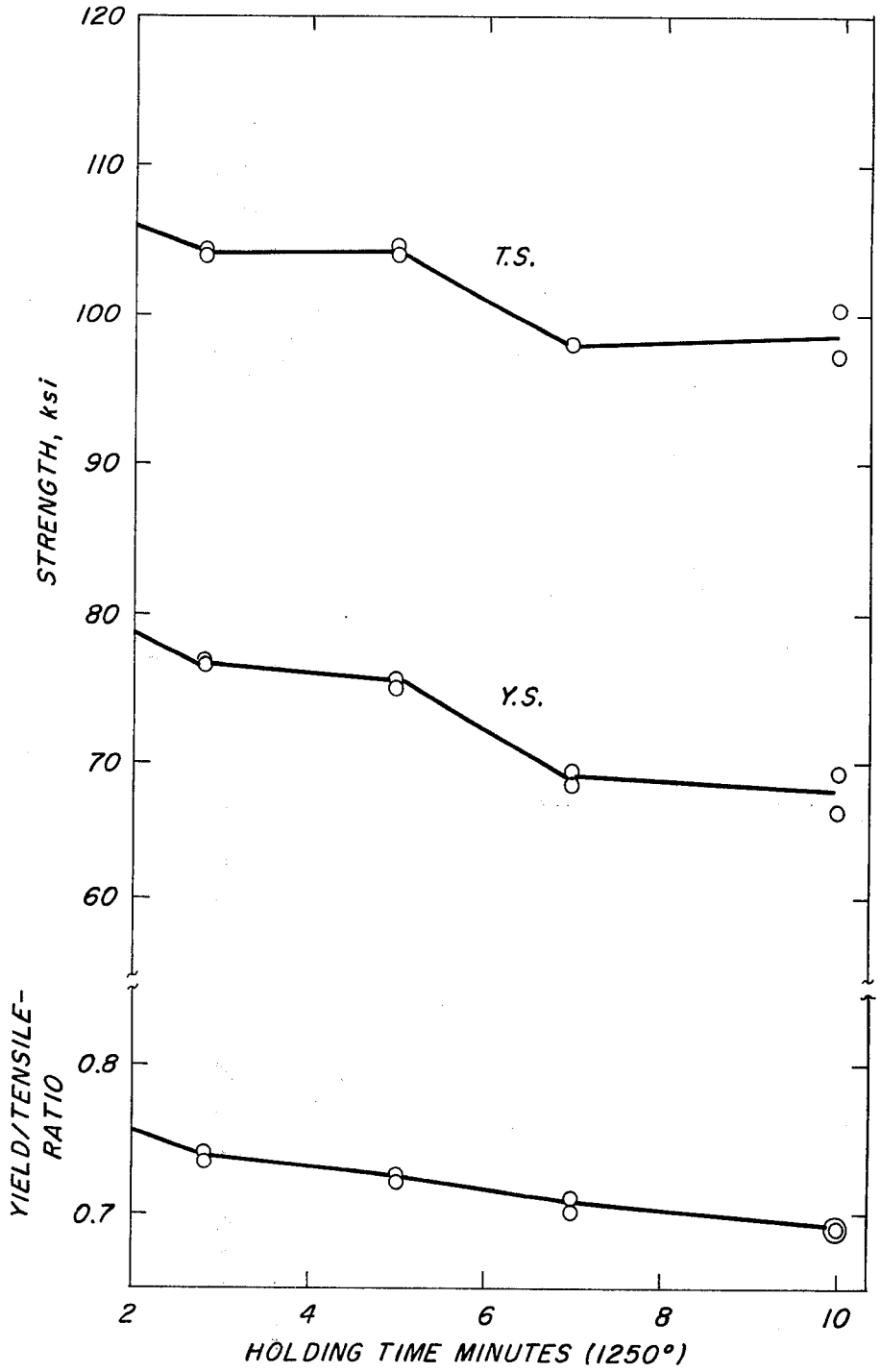
FIG. 6 is a graph illustrating the effect on the mechanical properties of an 8637 alloy steel rod, of holding at temperatue for various time periods.
Figure 7:
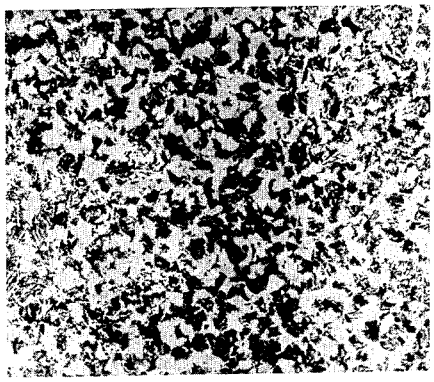
Figure 7:
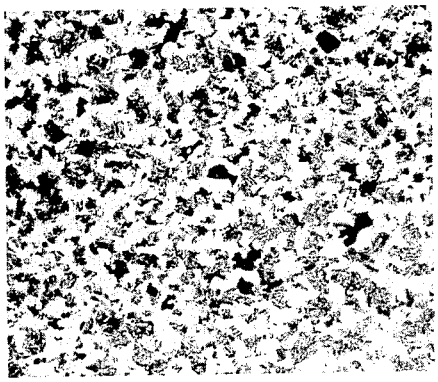
Figure 7:
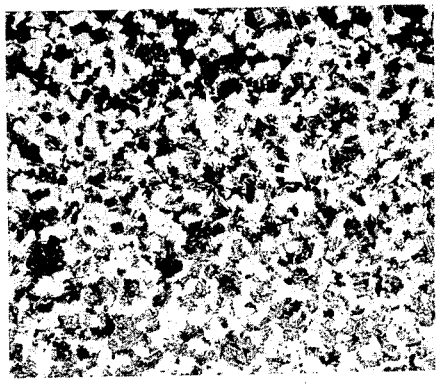
Figure 7:
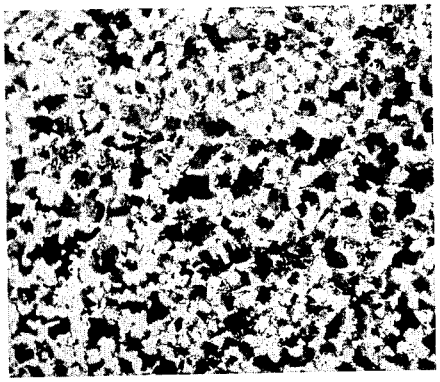
Figure 7:
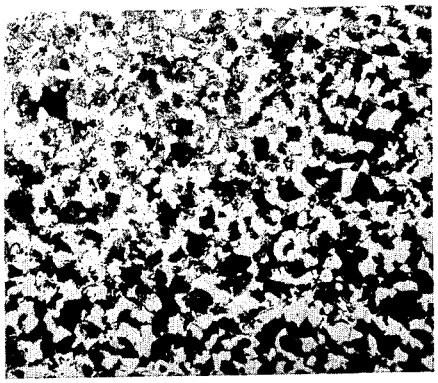

FIGS. 7*a* through *e* are photomicrographs of the metallurigical structures resulting from the different hold periods depicted in FIG. 6.

It has now been found that in the continuous, in-line processing of hot-rolled low alloy, low carbon rod; wherein such rod must be heat-treated in a constrained period (i.e. a maximum time period for achieving commercially practicable production) of time, that the above objects can be achieved by utilizing an interrupted cooling procedure. That is, in cooling the rod from its $A_3$ temperature to a temperature below 1,200°F, the rod is desirably held within a prescribed temperature range for a period of at least 2.0 minutes. This prescribed temperature range varies to a considerable extent, depending primarily on the carbon content of the rod and may be defined by the following, empirically determined equations:

When the carbon content of the rod is less than 0.28%, the prescribed temperaure ($T_p$) is given by;

$$T_p = 1{,}585 - 500 \cdot \%C$$

where $T_p$ is in °F, and %C is the actual carbon content of the steel.

When the carbon content of the rod is between 0.2 and 0.4%, the prescribed temperature is given by;

$$T_p = A_1 - 70$$

For most rod, $T_p$ in the latter case will be about 1,250°F. However, in those few cases wherein rod is employed having a significant amount of alloying elements, for example Mn or Ni, then the prescribed hold tempeature will vary as the $A_1$ temperature of the steel varies. In addition to plain carbon steels, these equations are similarly applicable to low alloy steels, i.e. steels containing less than about 3% total alloying elements.

In both instances, the rod is held within a temperature range of $T_p \pm 35°F$, preferably $\pm 25°F$, for a period of at least 2 minutes and preferably at least 3 minutes. However, the preferred hold time within such temperature range will vary to some extent depending, as shown hereinafter, on the concentration of the alloy elements. It should be noted from the equations above, that for rod with carbon in the range 0.20 to 0.28, there exists an alternative as to which prescribed temperaure range may be employed. The reasons for this overlap, as well as for the variation in holding temperature are thought to be as follows.

Steels containing less than 0.28% C have an extensive $A_1$–$A_3$ range within which a considerable amount of austenite can transform to ferrite. As noted above, the higher the transformation tempeature (of $\gamma$ to $\alpha$) the greater the tendency for grain growth. However, the yield strength of some 24 different runs of 1008 steel were plotted against corresponding grain size. The data points, while showing a general trend of yield strength to decrease with increasing grain size, nevertheless were widely scattered; suggesting that some other significant strengthening effect was occurring. It is believed that this strengthening effect, at least as far as the low alloy, low carbon steels are concerned, is due to aging on cooling to room temperature. Aging could either be caused by carbide precipitation or by nitride precipitation. Since the nitrogen content of the steels evaluated was quite low, and since the empirically determined prescribed temperature range was seen to be a function of carbon content, it is most logical to assume that the former is more important. With this assumption in mind, it would then follow that the higher the transformation temperature (in the $A_1$–$A_3$ range), the less carbon in solution in the ferrie formed, and therefore the less strengthening due to aging. However, in order for such decreased tendency to aging to be truly significant, a substantial amount of austenite must transform to ferrite in the first instance. Thus, as the carbon content increases, the prescribed hold temperature must decrease in order to achieve that substantial amount of ferrite. However, as carbon increases, the contribution of aging will decrease; as total strength becomes more and more dependent on the amount and kind of pearlite which is formed by the transformation of austenite. In view of the above, it is not surprising that at some intermediate carbon content (i.e. 0.2 to 0.28%) an overlap would exist in the significance of the various mechanisms affecting the total strength of the rod.

The beneficial effects of the interrupted cooling procedure of this invention may be seen from the following illustrative example; wherein five conventional grades of steel rod were rapidly cooled from a temperature of 1,700°F to various designated temperatures, held at each such temperature for a period of ten minutes (Note — this time is longer than required, as shown hereinafter) and thereafter cooled in vermiculite to simulate the cooling rates of rod bundles composed of nonconcentric rings. This latter cooling method was adaped to overcome the variations in cooling rates normally encountered when the rod is collected in such non-concentric bundles and air-cooled. The diameters and the chemical compositions of the rods are given below in Table I.

TABLE I

| AISI No. | Heat No. | Diameter, in. | C | Mn | P | S | Si | Cu | Ni | Cr | Mo |
|---|---|---|---|---|---|---|---|---|---|---|---|
| 1008[1] | N91596 | 0.221 | 0.07 | 0.38 | 0.009 | 0.008 | 0.022 | — | — | — | — |
| 1021[2] | L82441 | 0.314 | 0.21 | 0.50 | 0.009 | 0.020 | 0.008 | 0.011 | 0.006 | 0.006 | 0.004 |
| 1038[2] | L811979 | 0.314 | 0.39 | 0.76 | 0.011 | 0.025 | 0.21 | — | — | — | — |
| 4037[3] | L82362 | 0.304 | 0.38 | 0.82 | 0.012 | 0.023 | 0.23 | — | — | — | 0.23 |
| 8637[3] | A81376 | 0.360 | 0.35 | 0.80 | 0.015 | 0.018 | 0.20 | — | 0.47 | 0.49 | 0.20 |

[1]Rimmed steel.
[2]Silicon killed.
[3]Silicon-aluminum killed.

The resultant mechanical properties are depicted graphically in FIGS. 1 through 5. In all cases the beneficial effect of holding within the prescribed temperature range, is clearly evident. The 1020 steel, having an intermediate or "cusp" carbon content, exhibited two yield strength "minimums," one within the two-phase region at about 1,475°F and the other, below the $A_1$, at 1,250°F. In view of the significantly lower Y.S./T.S. ratio of the rod held within the two phase region, it is clear that a hold at the latter temperature is more desirable.

To illustrate the effect of increasing the holding time (within the bounds of the constrained time period) at the prescribed temperature, samples of the above rods were held at temperature, for intervals of 2 to 10 minutes. When the prescribed temperature hold is within the two-phase region, a time of as little as 2 minutes was seen to be sufficient to achieve substantial softening, and after about three minutes at temperature, essentially no significant benefit in softening occurred. Similarly, a period of only 2 minutes appeared sufficient for the plain carbon (1038) steel held at a temperature of 1,250°F. On the other hand, a time greater than about 5 minutes was required for the alloy steels. FIG. 6 shows the effect of holding time (at a temperature of 1,250°F) on mechanical properties of the 8637 steel rod. FIGS. 7*a* through *e* are photomicrographs of the rod structure for the same hold periods shown in FIG. 6. Since the alloy content of this latter steel will have the effect of decreasing the transformation rate (i.e., shifting the start and end lines of the Isothermal Transformation Diagram to the right), it would be expected that this steel would require somewhat longer times to achieve the desired decrease in yield srength. Clearly however, the determination of the minimum requisite hold time for any given steel, can be made rather easily by the simple isothermal holds at increased periods of time, i.e., as shown in FIG. 6. In general, when $T_p$ is below the $A_1$ it is desirable to hold for a period of time sufficient to achieve transformation of sufficient austenite to achieve substantial reduction in yield strength.

The interrupted cooling method of this invention is applicable to any of the well known processes for the production of steel rod. In virtually all such processes, the hot-rolled rod exits from the rolling mill at a temperature of about 1,750°–1,900°F, and is thereafter quenched to a lower temperature for further processing. Thus, in the most widely employed commercial process, the rod is thereafter delivered to laying reels which coil the rod, and deposit it onto a platform in form overlapping rings so as to form a rod bundle. The resultant bundles are then pushed onto a belt conveyor wherein they are slowly cooled, generally in air. The benefits of the instant invention may be achieved by a simple modification of the above process. For example, the belt conveyor can be covered (as shown in U.S. Pat. No. 3,547,421) with an insulated, tunnel-like device for counteracting the loss of heat, or by actually supplying additional heat through the use of electric or gas burners. However, the full benefits of the instant invention will be most advantageously realized through the use of the more modern methods, wherein the quenched rod is deposited onto a conveyor in the form of offset, spread apart rings or spirals (see, for example, U.S. Pat. Nos. 3,231,432 and 3,547,421). These latter procedures offer the advantage of producing a more uniformly heat-treated product.

The invention may therefore be conducted in the following preferred manner. The hot-rolled rod, on exiting from the finishing stand at a temperature within the range 1,750°–1,900°F, is rapidly cooled, e.g. in a conventional water box, to a temperature above $T_p$. The cooled rod is thereafter directed to a laying device which forms the rod into a series of offset rings which are deposited on a conveyor system for moving the rings, in the form of spirals, through a series of radiant heated furnaces; whereby the subsequent cooling of the rod is interrupted or sufficiently retarded in accord with the teachings herein. In cooling from the $A_3$ temperature to the prescribed range, the rod is preferably cooled at a rate as rapid as is feasible under the particular commercial operating conditions. Slow cooling to the prescribed temperature range will provide some small benefit in effecting a slight amount of grain growth. However, when operating within a constrained time period of no more than 15 minutes, the time spent in such slow cooling will be much more effectively employed, if it is utilized for holding the rod at a temperature within the prescribed range. Clearly, the rate should be sufficiently fast so as to provide at least the minimum time (i.e. 2 minutes) within the prescribed range; and, in addition, ample time for the rod to thereafter be cooled from the prescribed range down to reforming temperature. It may therefore be seen that the minimally desirable cooling rate (from $A_3$ to $T_p$) will be controlled, to a substantial extent, by (a) the extent of the temperature drop, i.e. when $T_p$ is below the $A_1$ the minimal cooling rate will be significantly faster than for the case when $T_p$ is in the two-phase region and (b) the constrained time period under which one is operating, i.e. cooling rate will necessarily be significantly faster for a constrained time of 2.5 minutes as opposed to one for 15 minutes. As a general rule, cooling from $A_3$ to $T_p$ will desirably be at an average rate, faster than 50°F/minute when $T_p$ is in the two-phase region, and faster than 200°F/minute when $T_p$ is below the $A_1$. The rod may be maintained within the prescribed temperature range, either by (i) radiant heat supplied, for example, by electric heaters or gas fired burners or (ii) use of a forced heating medium to achieve enhanced heat transfer. It is taught in U.S. Pat. No. 3,547,421, that gas heating is advantageous, in that it is capable, cocommitantly of providing a simple method for producing a nonoxidizing atmosphere. In the instant case, although such a protective atmosphere may be employed for its well known advantages, it will generally not be required. The rod which is still in spiral form on exiting from the retarded cooling furnaces, is then passed to a cooling zone where it is again rapidly cooled to reforming temperature (eg. 600°–900°F), and reformed into bundles. The reformed bundles are then collected and transported for further processing. It is desirable, subsequent to reforming, that the rod be cooled as slowly as possible. Low carbon rod benefits from such slow cooling in that overaging can then result, to further decrease any residual effects due to whatever aging may still be occurring in such steels. With respect to the medium carbon steels, slow cooling provides additional time for any retained austenite to further transform to comparatively softer products. With respect to the "cusp" steels, slow cooling will be beneficial in both of the above regards. In all cases, however, cooling should be sufficiently slow to prevent the formation of anything but an inconsequential amount of martensite, i.e., an amount of martensite which would significantly affect (a) subsequent drawing operations, e.g. seriously increasing the frequency of breaks during such drawing; or (b) the end-use properties of the drawn wire, e.g. poorer machinability.

I claim:

1. In the commercial production of extended lengths of low alloy steel rod having a carbon content below about 0.4%, wherein said rod is cooled from the $A_3$ temperature thereof to a temperature below 1,200°F in a constrained time period, said period being within the range of 2.5 to 15 minutes; an interrupted cooling procedure for enhancing the ability of said rod to receive subsequent cold-work, said procedure comprising, a. cooling said rod from said $A_3$ temperature to a temprature within the range of $T_p \pm 35$°F and holding the rod within said temperature range for a duration of at least 2 minutes, wherein $T_p$ is a function of carbon content as given by:

$(C < 0.28\%)\ T_p = 1{,}585 - 500 \cdot \%C$ $(C > 0.20\%)\ T_p = A_1 - 70$ b. thereafter cooling said rod to about room temperature.

2. The method of claim 1, wherein the carbon content of said steel rod is less than 0.28% and said constrained time period is no greater than 10 minutes.

3. The method of claim 2, wherein said temperature range is $T_p \pm 25$°F, and:

$T_p = 1{,}585 - 500 \cdot \%C$

4. The method of claim 3, wherein said duration is at least 3 minutes.

5. The method of claim 4, wherein the step (b) cooling is sufficiently slow to effect overaging and further softening of said steel rod.

6. The method of claim 5, wherein said cooling in step (a) is at an average rate in excess of 50°F per minute.

7. The method of claim 1, wherein the carbon content of said steel rod is greater than 0.20%, and said constrained time period is no more than 10 minutes.

8. The method of claim 7, wherein said temperature range is $T_p \pm 25$°F, and:

$T_p = A_1 - 70$

9. The method of claim 8, wherein said duration is at least 5 minutes.

10. The method of claim 9, wherein the step (b) cooling is sufficiently slow to prevent the formation anything but an inconsequential amount of martensite.

11. The method of claim 10, wherein said step (a) cooling is at average rate in excess of 200°F per minute.

12. An in-line process for the production of extended lengths of low alloy steel rod which comprises, a. forming said rod by hot-roling a steel billet having a carbon content below about 0.4%, the resultant hot-rolled rod exiting from the finishing stand at a temperature in excess of about 1,750°F, b. cooling said rod, and then depositing said cooled rod in the form of offset rings, onto a conveyor; whereby said rod is carried on said conveyor in the form of spirals, c. retarding the cooling of said rod spirals to a degree sufficient to maintain the rod within a prescribed temperature range of $T_p \pm 35$°F for a duration of 2 to 10 minutes, wherein $T_p$ is a function of carbon content, as given by:

$(C < 0.28\%)\ T_p = 1{,}585 - 500 \cdot \%C$ $(C > 0.20\%)\ T_p = A_1 - 70$ d. cooling said rod to reforming temperature, and reforming said rod spirals into a rod bundle, e. cooling the resultant rod bundle to about room temperature.

13. The method of claim 12, wherein the carbon content of said steel rod is less than 0.28%, and said hot-rolled rod, on exiting from the finishing stand, is cooled to a temperature in the vicinity of the $A_3$ temperature of said rod.

14. The method of claim 13, wherein said prescribed temperature range is $T_p \pm 25$°F, and:

$T_p = 1{,}585 - 500 \cdot \%C$

15. The method of claim 14, wherein said duration is at least 3 minutes.

16. The method of claim 15, wherein said reforming temperature is from 600° to 900°F.

17. The method of claim 16, wherein the rod bundles are cooled from said reforming temperature at a rate sufficiently slow to achieve overaging and further softening of said rod.

18. The method of claim 17, wherein said rod, is cooled from said temperature in the vicinity of the $A_3$ to said prescribed temperature range at an average rate in excess of 50°F/min.

19. The method of claim 12, wherein the carbon content of said steel rod is grater than 0.20%.

20. The method of claim 19, wherein said prescribed temperature range is $T_p \pm 25$°F, and:

$T_p = A_1 - 70$

21. The method of claim 20, wherein said duration is at least 5 minutes.

22. The method of claim 21, wherein said reforming temperature is from 600° to 900°F.

23. The method of claim 22, wherein the rod bundles are cooled from said reforming temperature at a rate sufficiently slow to prevent the formation of anything but an inconsequential amount of martensite.

24. The method of claim 23, wherein said hot rolled rod, on exiting from the finishing stand, is cooled to a temperature at least 100°F below the $A_3$, prior to being deposited on said conveyor.

* * * * *

UNITED STATES PATENT OFFICE
CERTIFICATE OF CORRECTION

Patent No. 3,939,015 Dated February 17, 1976

Inventor(s) Raymond A. Grange

It is certified that error appears in the above-identified patent and that said Letters Patent are hereby corrected as shown below:

Column 2, line 36, "temperatue" should read -- temperature --.

Column 2, line 65, "tempeature" should read -- temperature --.

Column 3, line 29, "tempeature" should read -- temperature --.

Column 6, line 37, subparagraph a, "temprature within" should read -- temperature within --.

Column 7, line 5, subparagraph a, "hot-roling" should read -- hot-rolling --.

Column 8, line 15, "grater" should read -- greater --.

Signed and Sealed this

*twenty-fifth* Day of *May 1976*

[SEAL]

*Attest:*

RUTH C. MASON
*Attesting Officer*

C. MARSHALL DANN
*Commissioner of Patents and Trademarks*